US005884137A

United States Patent [19]

Shida et al.

[11] Patent Number: 5,884,137

[45] Date of Patent: Mar. 16, 1999

[54] TWO-SIDED COPYING APPARATUS INCLUDING A REVERSING STOP MECHANISM

[75] Inventors: Toshio Shida; Atsushi Ogane; Naoki Otomo; Hisao Sato; Kenji Kato; Hideki Endo, all of Hachioji, Japan

[73] Assignee: Konica Corporation, Japan

[21] Appl. No.: 903,568

[22] Filed: Jul. 31, 1997

[30] Foreign Application Priority Data

Aug. 7, 1996 [JP] Japan ..... 8-208284
Sep. 13, 1996 [JP] Japan ..... 8-243237

[51] Int. Cl.[6] ..... G03G 15/00

[52] U.S. Cl. ..... 399/401; 271/186; 271/301; 399/402

[58] Field of Search ..... 399/401, 402; 271/186, 301

[56] References Cited

U.S. PATENT DOCUMENTS 4,787,616 11/1988 Sasaki et al. ..... 271/186 X
5,132,742 7/1992 Goto ..... 399/401

*Primary Examiner*—William Royer
*Attorney, Agent, or Firm*—Jordan B. Bierman; Bierman, Muserlian and Lucas

[57] ABSTRACT

A two-sided copying apparatus includes: an image forming device for forming an image on a recording sheet; a fixing device for fixing the image on the recording sheet; a branching device for branching the recording sheet on which the image was fixed by the fixing device to eject outside the apparatus or to feed again inside the apparatus for a two-sided image formation; a plurality of holding devices each for holding one edge of the recording sheet fed again inside the apparatus, wherein the holding device temporarily stops while holding the recording sheet and feeds again in a reverse direction onto a transfer station; and a supporting and guiding device for supporting and guiding the plurality of the holding devices.

28 Claims, 11 Drawing Sheets

FIG. 5 ( a )
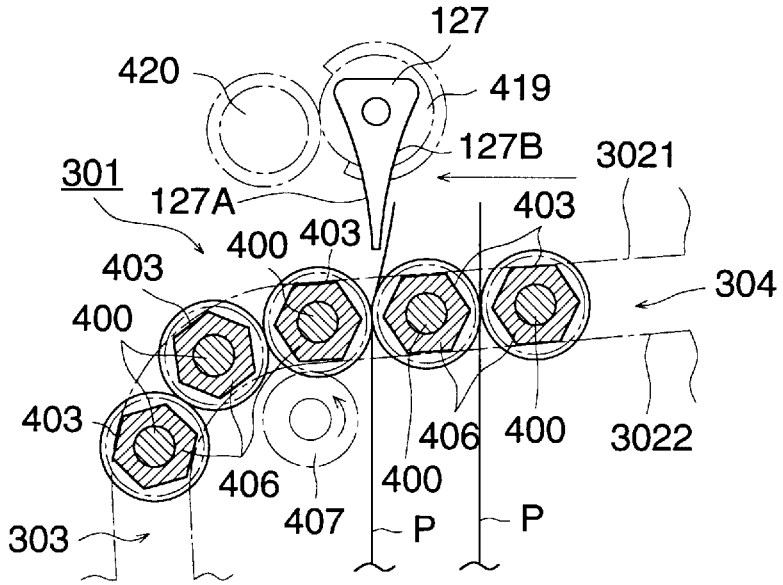
FIG. 5 ( b )
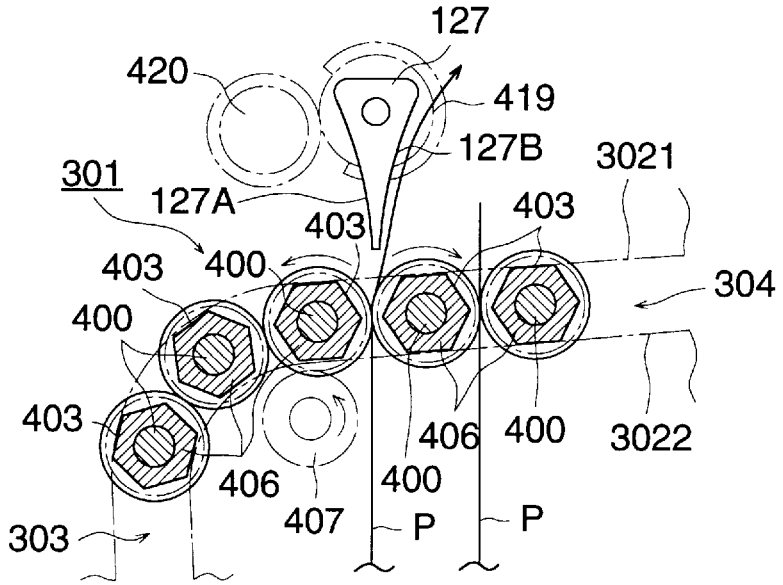

TWO-SIDED COPYING APPARATUS INCLUDING A REVERSING STOP MECHANISM

BACKGROUND OF THE INVENTION

The present invention relates to a recording sheet reversing device of a two-sided copying apparatus.

Conventionally, two-sided copying apparatus are widely known in which, after an image has been recorded on the obverse side of a recording sheet, the recording sheet is fixed; the recording sheet is reversed and re-fed; and after an image has been recorded on the reverse side of the recording sheet, the recording sheet is fixed; and images are respectively recorded on both sides of the recording sheet. As the structure of the two-sided copying apparatus, after the image has been recorded on the obverse side of the recording sheet, the recording sheet is fixed, the recording sheet is reversed by a recording sheet reversing mechanism, and the recording sheet is temporarily accumulated in an accumulating section. Next, the accumulated recording sheet is successively conveyed to a transfer section, and after the image has been recorded on the reverse side of the recording sheet, the recording sheet is fixed and delivered.

In such the two-sided copying mechanism, a mechanism by which the recording sheet is reversed and re-fed, can be formed into a small size, and thereby, even when it is housed in the copying apparatus, it does not require a large space. However, a mechanism of the accumulating section in which the recording sheet is temporarily accumulated after the recording sheet has been reversed and re-fed, is difficult to be smaller, and it is necessary to provide a large space in the copying apparatus so that the accumulating section is housed.

Further, the copying apparatus itself temporarily stacks and accumulates the recording sheet on a stacking section for the recording sheet, and re-feeds the recording sheet from the stacking section, and thereby, the image, recorded already on a one side of the recording sheet, adheres to other recording sheets and stains the recording sheets, or the recording sheets adhere to each other and cause double-sheet feeding when the recording sheets are re-fed, and thereby jamming easily occurs, which are disadvantageous.

Accordingly, there is a drawback in which the overall size of the apparatus becomes larger. Then, as a mean to provide the accumulating section of the recording sheet without increasing the size of the copying apparatus, a means is proposed in which a portion of a sorter, which is mounted onto a sheet delivery section, is utilized, and an accumulating section on which the recording sheet is accumulated, is provided. As the means, Japanese Utility Model Open to Public Inspection No. 166248/1984, Japanese Patent Publication Open to Public Inspection Nos. 109071/1986, and 130128/1986, are widely known. As described above, an increase of the overall size of the copying apparatus is prevented by utilizing the sorter position.

As described above, when a two-sided copying mechanism is provided in the copying apparatus, and the recording sheet reversing mechanism and the recording sheet accumulating mechanism are housed in the apparatus, the overall size of the copying apparatus becomes large. Accordingly, as described above, a means by which a portion of the sorter position is utilized and the accumulation section of the recording sheet is provided, and the recording sheet is reversed, should be essentially provided in the copying apparatus. In this case, the customer who does not always need the sorter, is obliged to purchase a useless apparatus.

Further, because a portion of the sorter is utilized, the number of sheet delivery trays for the sorter to be provided, should be reduced, resulting in reduction of the number of sets of recording sheets to be delivered.

Accordingly, in the case of a copying apparatus in which the sorter is not used, only the recording sheet accumulating section is provided outside the apparatus, and therefore, the size of the overall structure of the copying apparatus can not be reduced.

SUMMARY OF THE INVENTION

An object of the present invention is to provide a two-sided copying apparatus in which a two-sided copying mechanism, the size of which is reduced, is housed; double-sheet feeding does not occur when a recording sheet is re-fed from the inside of the apparatus; and further safe and sure re-feeding of the recording sheet, by which staining of the recording sheet is prevented, can be realized.

The above object can be attained by a two-sided copying apparatus having the following structure: an image forming means to form an image on a recording sheet; a fixing means to fix the image on the recording sheet; a branch means by which the recording sheet is caused to branch off so that the recording sheet, on which the image is fixed by the fixing means, is delivered outside the copying apparatus, or so that the recording sheet is re-fed into the copying apparatus in order to form two-sided images; a plurality of holding means to hold one end of the recording sheet, re-fed into the copying apparatus, wherein the holding means temporarily stops while holding one end of the recording sheet, and re-feeds the recording sheet into the transfer section; and a support and guide means to support and guide the plurality of holding means.

BRIEF DESCRIPTION OF THE DRAWINGS

FIGS. 5(*a*) and 5(*b*) are sectional views showing recording sheet re-feeding movement by the recording sheet holding means and the recording sheet guide member for two-sided copying of the present invention.

DETAILED DESCRIPTION OF THE PREFERRED EMBODIMENT

Figure 1:
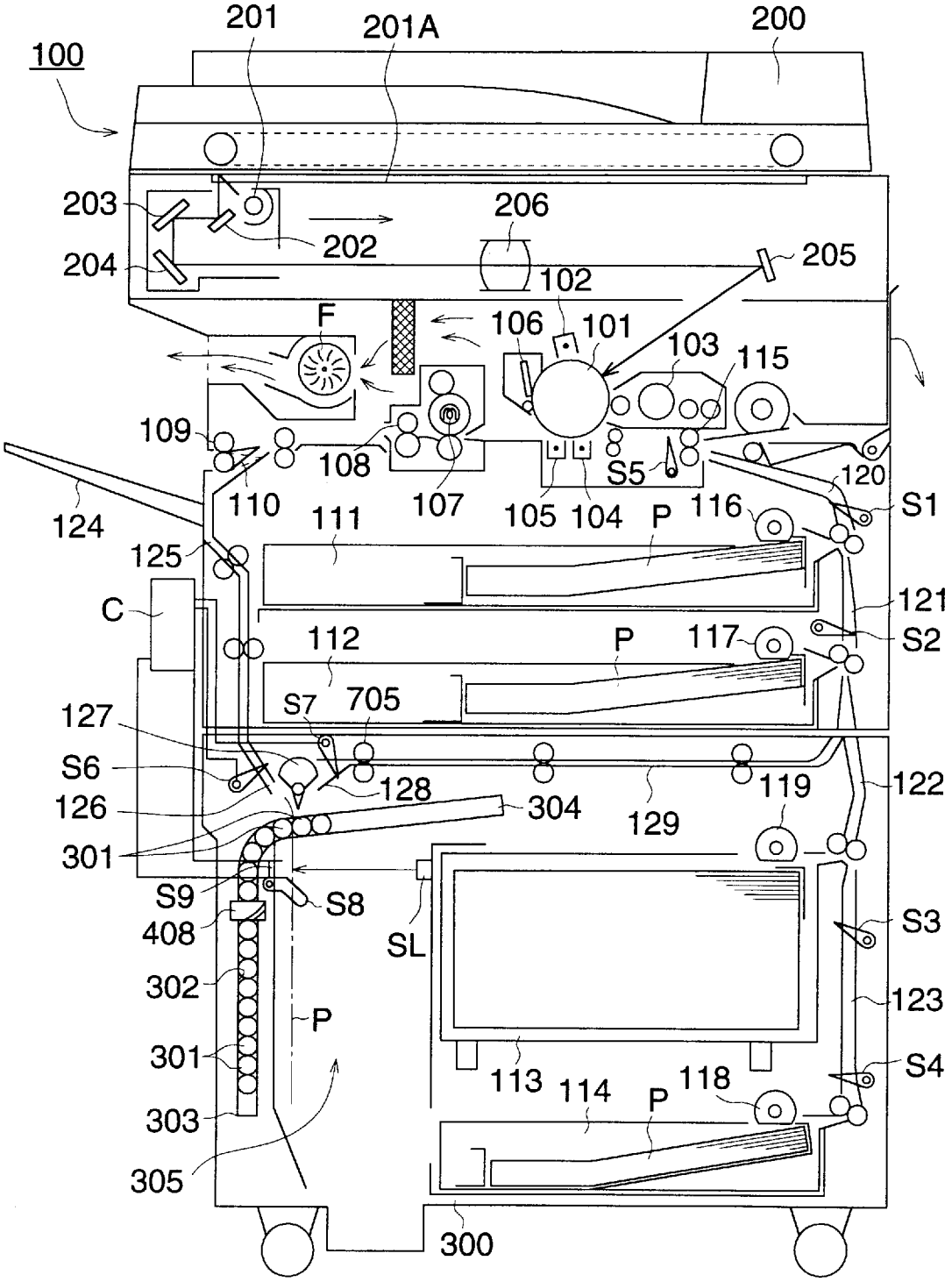
FIG. 1 is a view showing the entire structure of a two-sided copying apparatus of the present invention.

FIG. 1 is a front view showing the entire structure of a two-sided copying apparatus 100 of the present invention.

In the structure of the two-sided copying apparatus 100, a charger 102, developing device 103, a transfer device 104, a separator 105, and a cleaning device 106 are respectively arranged in the order of movement around a photoreceptor drum 101 provided in the two-sided copying apparatus 100. After the surface of the photoreceptor drum 101 has been charged by the charger 102, a document which is automatically sent by an automatic document feeding device 200, provided on the upper portion of the two-sided copying apparatus 100, to an exposure section 201A, is irradiated by an exposure lamp 201; the photoreceptor drum surface is exposed by mirrors 202, 203, 204, 205 and an image forming lens 206 from the arrowed direction, and an electrostatic latent image is formed on the photoreceptor drum surface. Next, the electrostatic latent image is developed by the developing device 103, and a visual toner image is formed on the photoreceptor drum surface.

On the other hand, upper and lower sheet feed cassettes 111 and 112 are arranged in the two-sided copying apparatus 100 in the vertical relationship, and a sheet feed unit 113 from which a large number of recording sheets can be fed, and a sheet feed cassette 114 are respectively provided in a carriage 300 in which the two-sided copying apparatus 100 is mounted.

This sheet feeding system is provided as follows. A document is sent to an exposure section 201A by the automatic document feeding apparatus 200 or by a manual operation; when a document size is automatically detected by document size detection, or when the recording sheet P, the size of which is manually designated, is fed from each sheet feed apparatus, the recording sheet P of the size designated as described above, is conveyed while being detected by recording sheet detection members S1, S2, S3, or S4 in any of recording sheet guide sections 120, 121, 122, 123, respectively provided in the two-sided copying apparatus 100 and the carriage 300; after the recording sheet P temporarily stops at a recording sheet detection member S5, provided at a register roller 115 position, it is fed so as to coincide with the toner image formed on the photoreceptor drum 101.

Sheet feed rollers 116, 117, 118, 119 are respectively provided in the sheet feed cassettes 111, 112, 114 and the sheet feed unit 113, and thereby, the recording sheet P is fed.

The toner image formed on the photoreceptor drum 101 is transferred onto the recording sheet P by the transfer device 104, the recording sheet P is separated from the photoreceptor drum 101 by the separator 105, and after that, the toner image on the recording sheet P is thermally fixed by a thermal fixing device 107, and the recording sheet P is conveyed by a conveyance roller 108 towards the sheet delivery direction.

The letter F is an exhausting device which exhausts ozone generated by a charging action of the charger 104, and heat generated from the thermal fixing device 107 provided in the two-sided copying apparatus 100, and thereby, the photoreceptor drum 101 is protected.

Next, in the case of one-sided copying, the recording sheet P is delivered on a delivery tray 124 by a delivery roller 109 as it is, however, in the case of two-sided copying, a conveyance path is switched by the recording sheet branch member 110, and the recording sheet P is conveyed to the first recording sheet conveyance section 125. Initially, the leading edge of the conveyed recording sheet P is detected by the detection member S6 provided in the carriage 300, and detected information is inputted into a control section C. Then, the recording sheet P is conveyed to a recording sheet accumulation reversing section 302 provided in the carriage 300. A recording sheet guide member 127 is provided in the carriage 300 so that the recording sheet P is supplied to a predetermined position in the recording sheet accumulation reversing section 302, when the recording sheet P is conveyed to the recording sheet accumulation reversing section 302.

The recording sheet P conveyed through the first recording sheet conveyance section 125, is supplied from a supply exit 126, provided on the end of the first recording sheet conveyance section 125, to a large number of rollers 301, which are composed of plural pairs of a drive roller and a driven roller, (hereinafter, which are called a one paired roller group), by being guided by the recording sheet guide member 127. The recording sheet accumulation reversing section 302 is formed into the reversed L-shape, which is integrally structured by a vertical guide portion 303 and an inclined guide portion 304, and the recording sheet P is supplied between the one paired roller group 301 in the vertical guide portion 303 and the inclined guide portion 304, as described above.

In the case where the recording sheet P is supplied between the one paired roller group 301, when the recording sheet P is detected by the detection member S6, only the one paired roller group 301 which is in the recording sheet supplied position, starts the rotation in the conveyance direction by the control section C, and the recording sheet P drops in the vertical direction into a stack section 305 by the self weight of the recording sheet P while being held by the roller pairs. In this case, when the leading edge of the dropping recording sheet P is detected by the detection member S8, and the trailing edge of the recording sheet P is detected by the detection member S6, the control section C stops the rotation of the one paired roller group 301 after the one paired roller group 301 has been rotated for a predetermined period of time. When the one paired roller group 301 is stopped, the recording sheet P is stopped under the condition that a predetermined length portion of the trailing edge of the recording sheet P remains being held between the one paired roller group 301, and the recording sheet P is accommodated vertically in a stack section 305. The condition of accommodation of the stack section 305 is detected by a non-contact detection means composed of a light source SL and a light receiving element S9, and is inputted into the control section C.

When the second recording sheet P is conveyed through the recording sheet conveyance section 125, the group of the roller pairs 301 moves along the inclined guide portion 304 while holding the trailing edge of the first recording sheet P and stops, and the next one paired roller group 301 is on standby at the position of the supply exit 126 and stops. When the second recording sheet P is detected by the detection member S6, only the next one paired roller group 301 is rotated, and holds the trailing edge of the recording sheet P while a predetermined length portion of the recording sheet P is remaining, the recording sheet P is stopped, and is vertically accommodated in the stack section 305.

Figure 8:
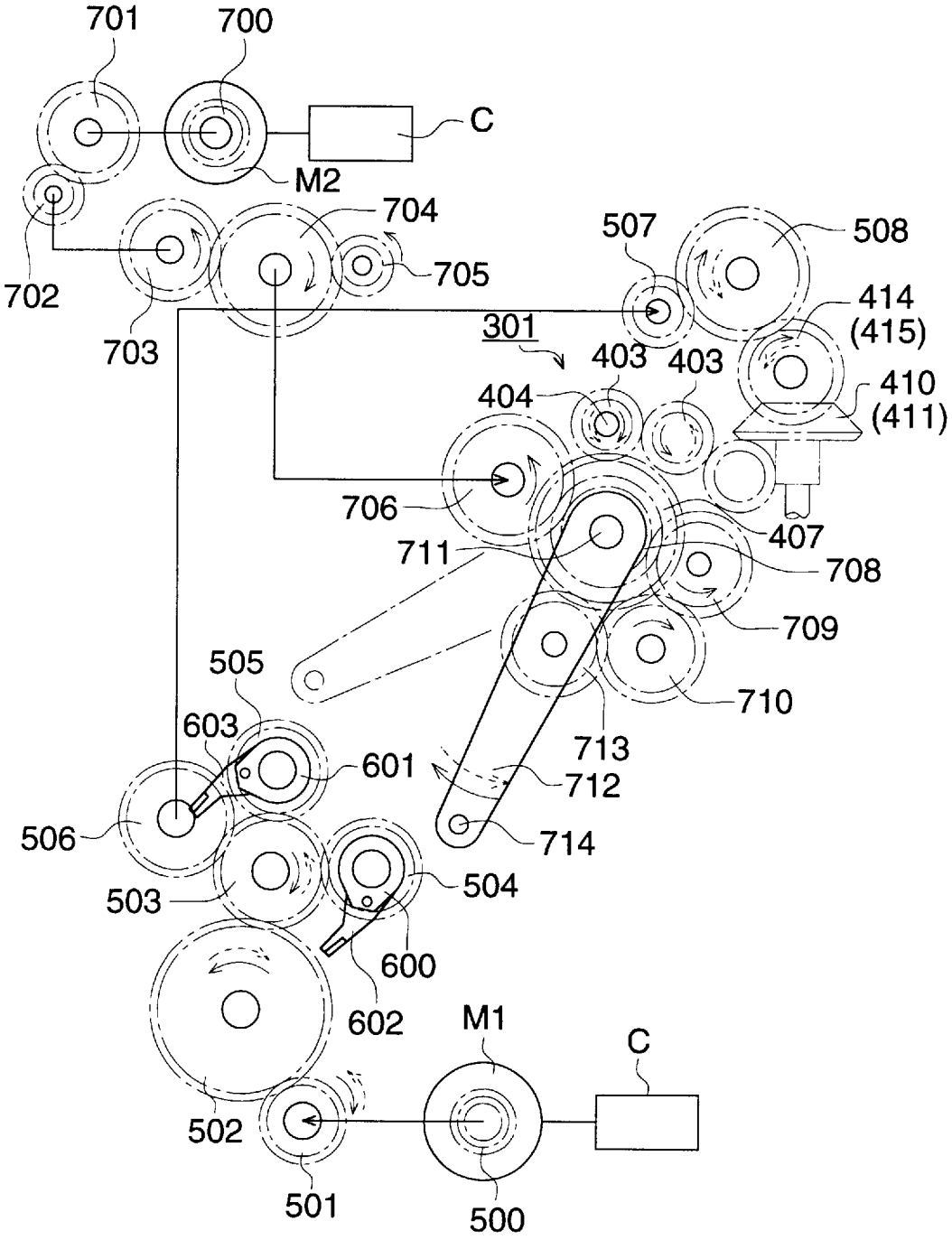
FIG. 8 is a view showing the structure of a driving mechanism of the recording sheet holding means for two-sided copying of the present invention.

When a predetermined number of recording sheets P are accommodated in the stack section 305, the first one paired roller group 301 returns to the recording sheet guide member 127 position, or rotation of the one paired roller group 301 is reversed at the above-described position, and the recording sheet feeding is started from the trailing edge of the recording sheet, according to the above-described two-sided copying method. Thus fed recording sheet P is guided by a guiding portion of the recording sheet guide member 127, and the leading edge of the recording sheet P is detected by the detection member S7. After that, the recording sheet P is conveyed by rollers driven by gear 705 in the second recording sheet conveyance section 129, and conveyed again to the register roller 115 position after the detection of the detection members S2 and S1. Gear 705 is driven by driving motor M2 as shown in FIG. 8. After the recording sheet P has temporarily stopped at S5, the recording sheet P is fed so that it coincides with the toner image formed on the photoreceptor drum 101, and an image is transferred onto the reverse side of the recording sheet by the transfer device 104. After the recording sheet P is separated by the separator 105, the image is thermally fixed by the thermal fixing device 107. The recording sheet P is conveyed by the conveyance roller 108 in the sheet delivery direction, and delivered onto the sheet delivery tray 124.

Figure 2:
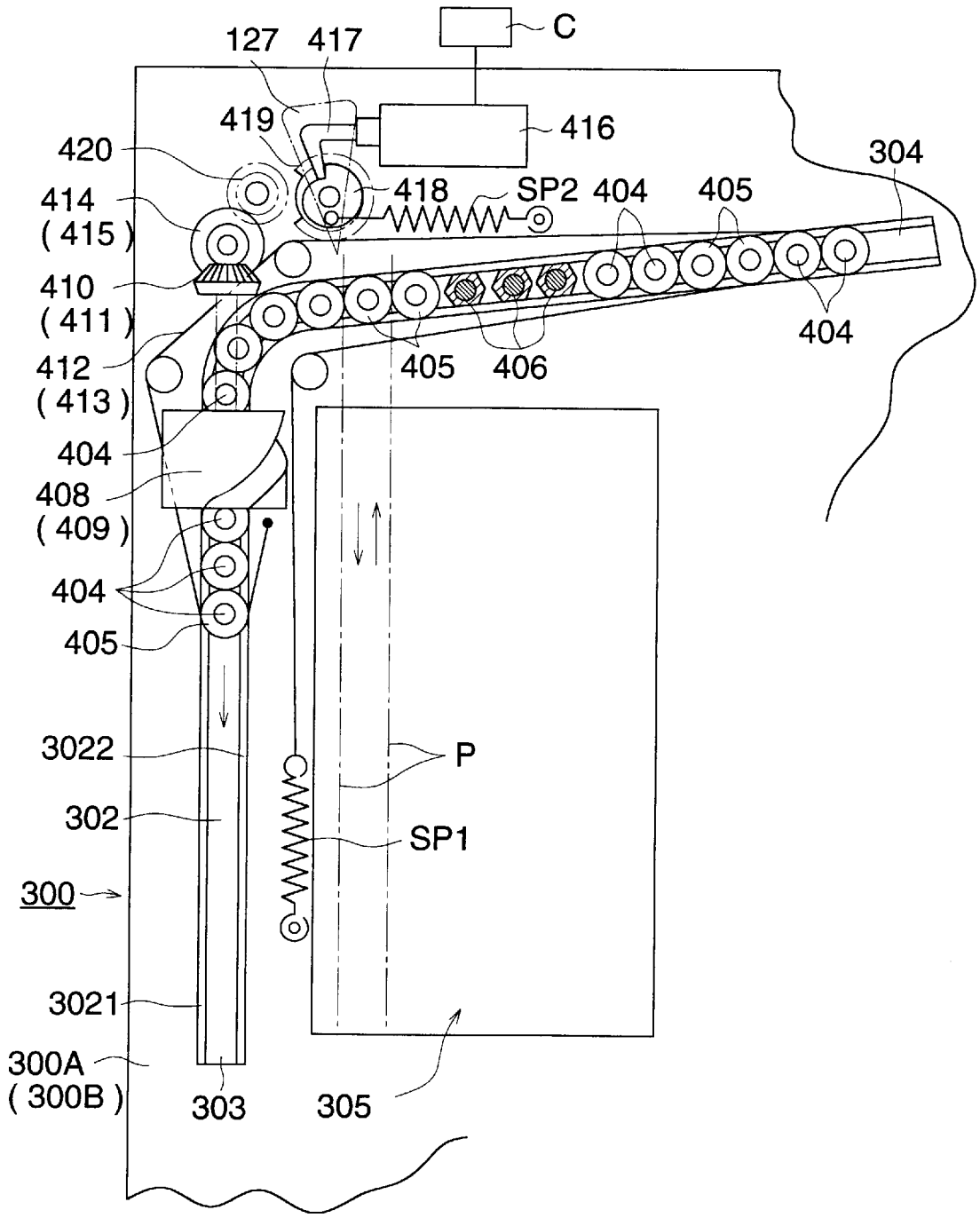
FIG. 2 is a view showing the structure of a recording sheet holding means and a recording sheet accumulation reversing section for two-sided copying of the present invention.
Figure 3:
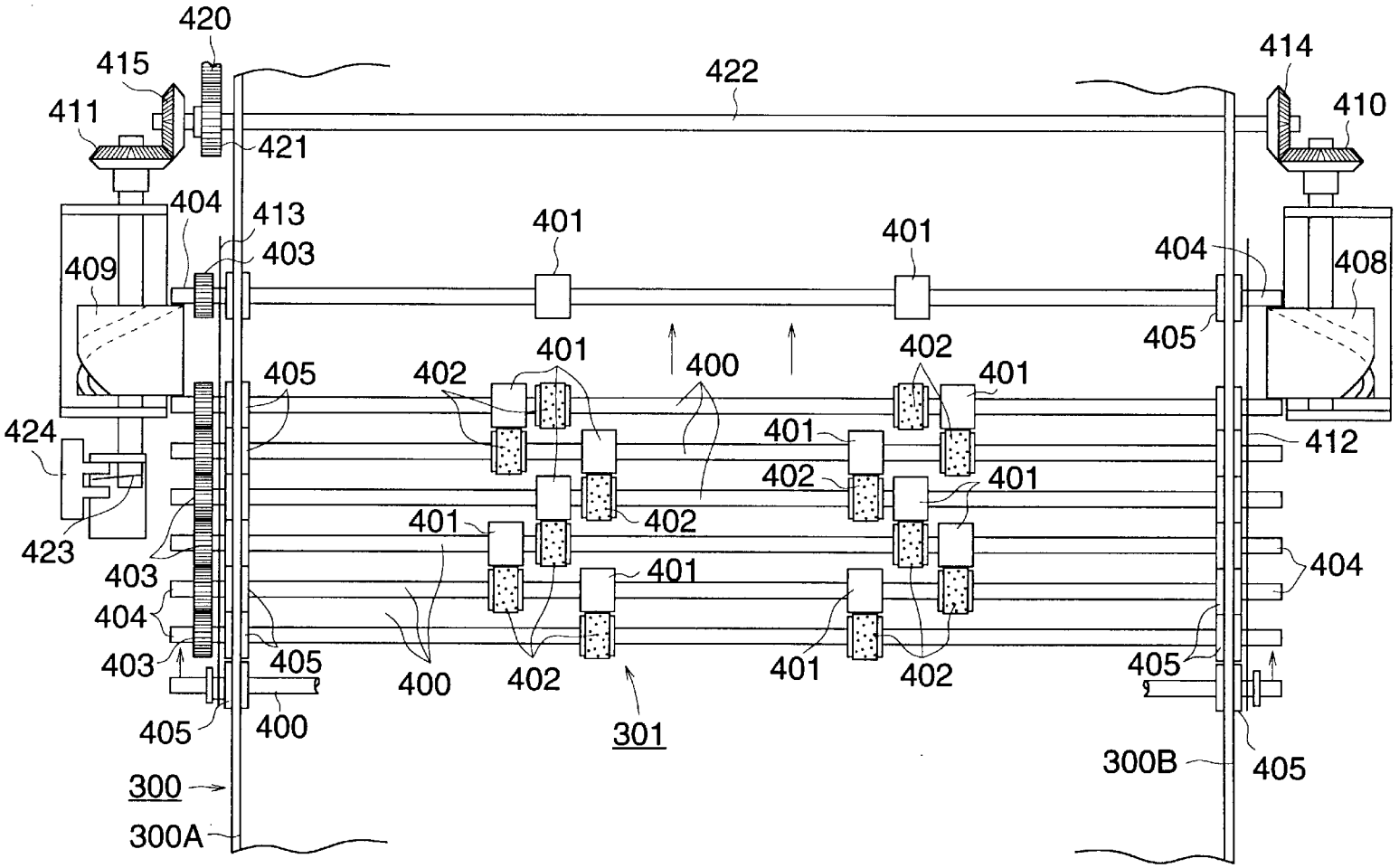
FIG. 3 is a side view showing the recording sheet accumulation reversing section and the recording sheet holding means of the present invention.

FIGS. 2 and 3 are a front view and a side view showing a driving mechanism of the one paired roller group 301 mounted in the recording sheet accumulation reversing section 302 so as to be movable.

The inside of the carriage 300 is structured with side plates 300A and 300B which are provided on both sides of the carriage 300. On side plates 300A and 300B, the recording sheet accumulation reversing sections 302, which are symmetrically formed into the reversed L-shape, are provided as shown in FIG. 2, and a large number of bearing members 405 are engaged with each other so that they can be freely moved, in the vertical guide section 303 and the inclined guide section 304. As shown in FIG. 3, end portions 404 of a plurality of shafts 400 are provided through the bearing members 405, and the end portions 404 respectively protrude outside the bearing members 405.

Further, grooved cams 408 and 409 are provided at movement positions of the end portions 404 of the shafts 400, which are outside positions of the vertical guide portions 303. The grooved cams 408 and 409 are respectively arranged vertically on a portion of the side plates 300A and 300B, and are provided together with bevel gears 410 and 411 so that they can be moved freely. Further, in order to simultaneously rotate the grooved cams 408 and 409, bevel gears 414 and 415 are provided on both ends of shafts 422 which penetrate the side plates 300A and 300B, and are engaged with the bevel gears 410 and 411.

Further, a gear 419, one portion of which is cut out, (it will be called hereinafter the cutout gear), is provided opposing an intermediate gear 420 as shown in FIG. 2, on a drive gear 421 provided on a side portion of the bevel gear 415 on one end of the shaft 422. A stopper 418 is fixed on a shaft of the cutout gear 419, the rotation force is always given in one direction by a spring SP2, and an engagement claw 417, operated by a solenoid 416, is engaged with the stopper 418. A cutout position of the cutout gear 419 is opposite to the intermediate gear 420 except the operation time of the solenoid 416, and when the engagement claw 417 releases the stopper 418, the cutout gear 419 is engaged with the intermediate gear 420 by the spring SP2, and when the gear is rotated once, the rotation stops at the cutout position of the cutout gear 419, and the engagement claw 417 is engaged again with the stopper 418 and is stopped. That is, the cutout gear 419 is stopped at a predetermined position by only one rotation. The cutout gear 419 is provided such that it is interlocked with the recording sheet guide member 127, so that the recording sheet guide member 127 is rotated by a predetermined rotation angle and the recording sheet P is guided.

On the other hand, as shown in FIGS. 2 and 3, wires 412 and 413 are provided so that the bearing members 405 are pressed inward, wherein the bearing members 405 are respectively provided at the end portions, in a large number of bearing members 405 which are provided together in the recording sheet accumulation reversing section 302 formed into the reversed L-shape. Each one end of the wires 412 and 413 is respectively fixed on the side plates 300A and 300B, and springs SP1, (only a spring SP1 on the wire 412 side is shown in the drawing), are respectively provided on the other end. The end portions 404 of the shafts 400, arranged in the vertical direction guide section 303, are structured so that they are always in contact with the upper end portions and the lower end portions of the grooved cams 408 and 409.

Further, as shown in FIG. 3, a plurality of drive rollers 401, fixed on the shaft 400 which is provided in bearing members 405 so as to be freely rotatable, and driven, and driven rollers 402, which are rotated in contact with the drive rollers 401 and are provided on the shaft 400 so as to be freely rotatable, are alternately provided on the same shaft. In the same manner, a plurality of drive rollers 401 driven by the shaft 400, and driven rollers are alternately provided on another shaft 400, which is provided in parallel with the above-described shaft. The driven roller 402 is in contact with the drive roller 401 on the another shaft 400, and thereby, the one paired roller group 301 is structured. A gear 403 which individually drives the shaft 400, is provided fixedly on the end portion 404 of the shaft 400.

Further, as shown in FIG. 3, the drive roller 401 and the driven roller 402 are not provided on the end shafts 400, around which wires 412 and 413 are wound. As shown in the drawing, a groove is provided on the bearing member 405 and is structured so that the wires 412 and 413 are wound and not dropped out, and is used for only the operation by which the one paired roller groups are surely in contact with each other.

A detection member 423 is fixed on the shaft of the grooved cam 409, the rotating condition of the grooved cam 409 is detected by a detection device 424, and the rotation of the grooved cams 408 and 409 is controlled by the control section C.

Figure 4:
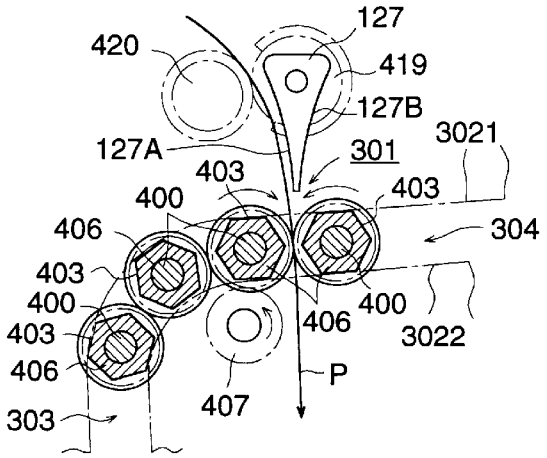
FIGS. 4(*a*), 4(*b*) and 4(*c*) are sectional views showing movement of the recording sheet holding means and a recording sheet guide member for two-sided copying of the present invention.
Figure 4:
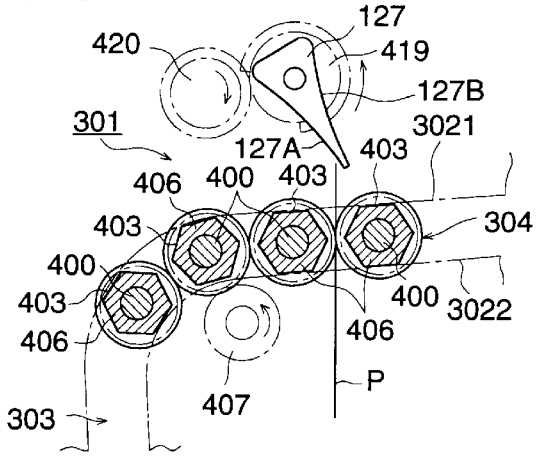
Figure 4:
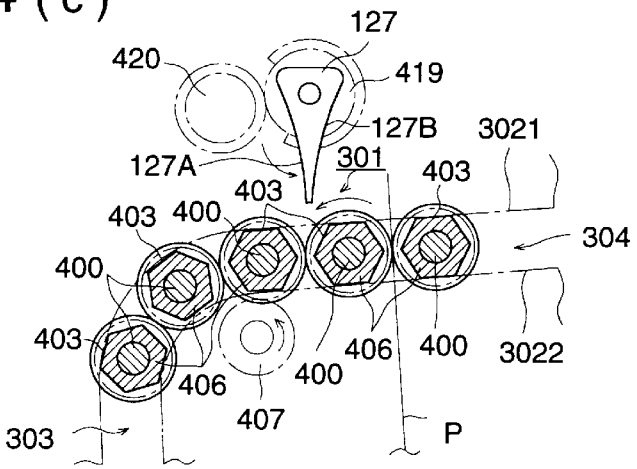

FIGS. 4(*a*), 4(*b*) and 4(*c*) are sectional views respectively showing the condition that the recording sheet P is conveyed to the one paired roller group 301, the recording sheet P is held, and the one paired roller group 301 is successively moved.

FIG. 4(*a*) shows a sectional view of hexagonal receiving portions 406 which are formed on the plurality of bearing members 405 through which the shafts 400 penetrate, in the vertical guide section 303 of the recording sheet accumulation reversing section 302 and the inclined guide section 304 of the recording sheet accumulation reversing section 302. The receiving portion 406 is engaged with protection portions 3021 and 3022 such that flat portions of the receiving portion 406 are supported and guided by the protection portions 3021 and 3022, shown in FIG. 2, provided on both edges of the inclined guide section 304. The recording sheet P is supplied between the one paired roller group 301, composed of drive rollers 401 and driven rollers 402, which are respectively provided on the shaft 400.

As a supply method of the recording sheet P, the recording sheet P conveyed on the first recording sheet conveyance section 125, shown in FIG. 1, is detected by the detection member S6, and after the recording sheet P has passed, the recording sheet P is supplied in the arrowed direction between the one paired roller group 301 by the guide of an one end guide edge 127A of the recording sheet guide member 127. Simultaneously with the start of supply of the recording sheet P, the drive gear 407 engaged with the gear 403 is rotated by a motor (shown in FIG. 7), by a signal outputted from the control section C according to a detection signal of the passage of the recording sheet P by the detection member S6. By this rotation, only the drive roller 401 provided on the shaft 400, is rotated clockwise, and the recording sheet P is conveyed in the vertical direction to the accumulation section 305 while it is held between the one paired roller group 301, composed of the driven roller 402 in contact with the drive roller 401.

In FIG. 4(*b*), the one paired roller group 301 is stopped under the condition that the leading edge of the recording sheet P conveyed to the one paired roller group 301, remains between the one paired roller group 301. Under this condition, the recording sheet P is moved while being held between the one paired roller group 301, in the right direction shown by an arrow, in the inclined guide section 304 by the rotating motion of the grooved cams 408 and 409, shown in FIGS. 2 and 3. Simultaneously, as described in FIG. 2, the engagement claw 417 engaged with the stopper 418 provided on the recording sheet guide member shaft is disengaged by the movement of the solenoid 416, and the cutout gear 419, coaxially provided on the recording sheet guide member shaft, is rotated counterclockwise by the force of the spring S2. Under this rotating condition, a portion of the cutout gear 419 is engaged with the intermediate gear 420 rotating clockwise, and the top of the recording sheet guide member 127 is rotated counterclockwise together with the cutout gear 419 so that the leading edge of the recording sheet P is withdrawn.

Next, as shown in FIG. 4(*c*), the one paired roller group 301 moves right while holding the recording sheet P in the inclined guide section 304, and accommodates the recording sheet P in the accumulation section 305. On the other hand, the engagement of the cutout gear 419 with the intermediate gear 420 is released at the position at which the recording sheet guide member 127 is rotated once counterclockwise, further, the engagement claw 417 is engaged with the stopper 418, and these members return to the position shown by FIG. 4(*a*) and stop. Accordingly, the recording sheet guide member 127 also stops at a predetermined position. Further, the drive gear 407 is engaged with the next gear 403 which comes next to the position, rotated counterclockwise and rotates the one paired roller group 301 when the next recording sheet P is supplied, the recording sheet P is conveyed again by being guided by the one end guide edge 127A of the recording sheet guide member 127, and the recording sheet P is held and conveyed by the one paired roller group 301.

FIGS. 5(*a*) and 5(*b*) are sectional views showing motions by which the recording sheet P, accommodated in the accumulation section 305, is re-fed for two-sided copying.

In FIG. 5(*a*), the one paired roller group 301 holding the recording sheet P, accommodated in the accumulation section 305, moves left in the inclined guide section 304 by the reverse rotating motion of the grooved cams 408 and 409 shown in FIGS. 2 and 3, and stops at the position at which the leading edge of the recording sheet P comes into contact with the other end guide edge 127B surface of the recording sheet guide member 127. Simultaneously with the stoppage, the gear 403 of the moved one paired roller group 301 is engaged with the drive gear 407.

Next, as shown in FIG. 5(*b*), the drive gear 407 is rotated counterclockwise, and only the drive roller 401 on the shaft 400, in the one paired roller group 301, is rotated by the gear 403 engaged with the drive gear 407 in order to drive the one paired roller group 301, and the recording sheet P held by the other driven roller 402 is re-fed. The re-fed recording sheet P is conveyed while being in contact with the surface of the other end guide edge 127B of the recording sheet guide member 127, and is conveyed on the second recording sheet conveyance section 129 shown in FIG. 1. Guide 128 is adapted to reverse sheet P. The recording sheet P is detected by the detection members S2, S1 and S5, the toner image formed on the photoreceptor drum 101 is transferred onto the reverse side of the recording sheet P by the transfer device 104, the recording sheet P is separated by the separator 105, and after that, it is fixed by the fixing device 107 and is delivered onto the delivery tray 124.

As described above, the one paired roller group 301 holding the recording sheet P successively moves left to the position at which the leading edge of the recording sheet P is in contact with the surface of the other end guide edge 127B of the recording sheet guide member 127, and re-feeds the recording sheet P.

Incidentally, when the recording sheet P is re-fed, the recording sheet guide member 127 is not rotated, and held at the recording sheet guide position.

Figure 6:
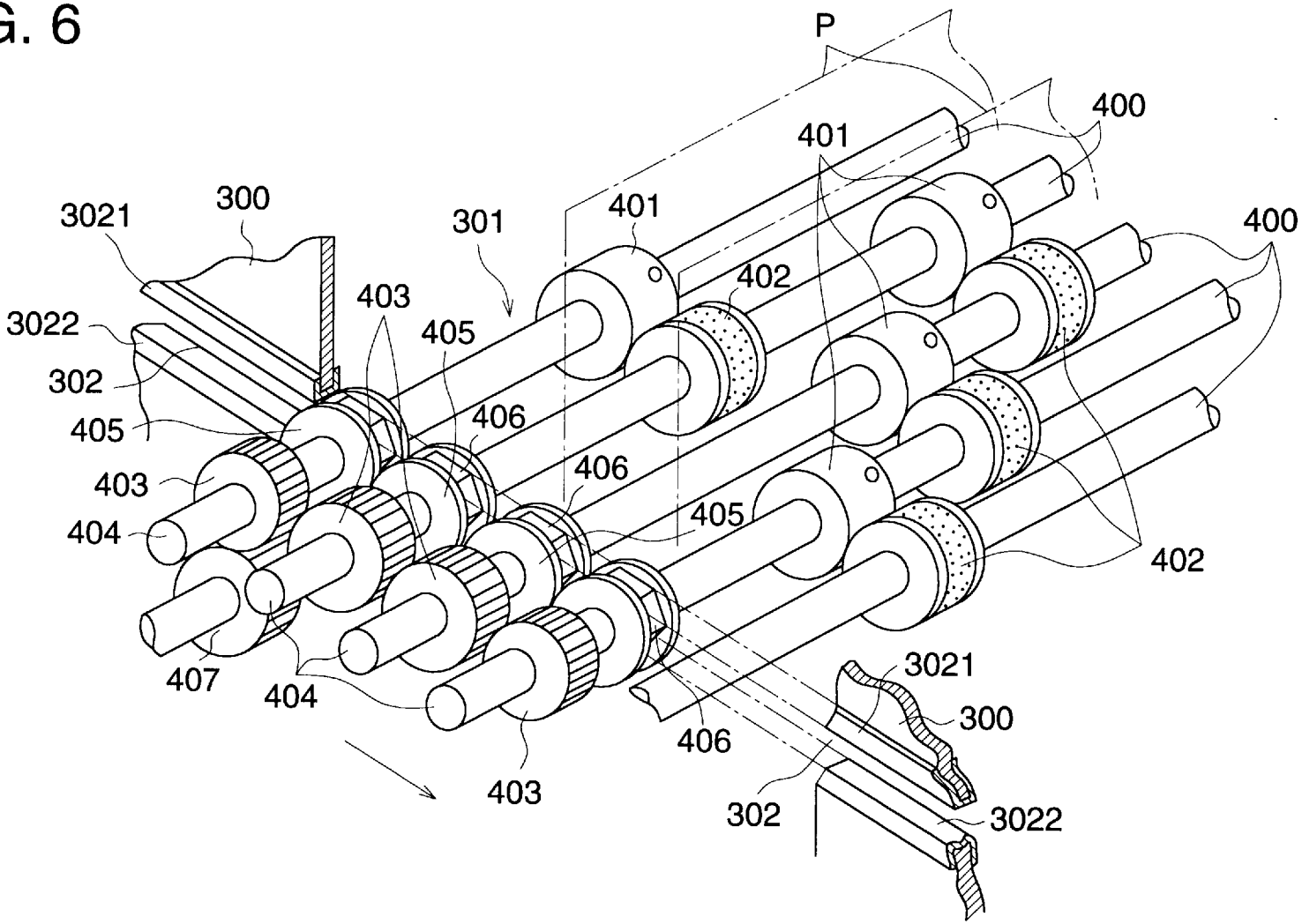
FIG. 6 is a perspective view showing the recording sheet holding means for two-sided copying of the present invention.

FIG. 6 is a perspective view showing a portion of the bearing member 405 provided in the recording sheet accumulation reversing section 302 of the carriage 300 so as to be freely movable, the drive roller 401 which is fixed on the shaft 400, rotatably provided on the bearing member 405, and driven, the driven roller 402 rotatably provided on the shaft 400, and the gear 403 fixed on the shaft 400.

Protection members 3021 and 3022, formed of resin or similar material, are coated on the recording sheet accumulation reversing section 302, which is formed into groove-like and provided on the carriage 300, so that the bearing members 405 can be smoothly moved. Further, the receiving portion 406 which is engaged with the recording sheet accumulation reversing section 302 of the bearing member 405 is formed into, for example, a hexagonal one, and is guided by the surface contact with the protection members 3021 and 3022 of the recording sheet accumulation reversing section 302, and prevents the bearing member 405 from being rotated by the rotation of the shaft 400.

As described above, the gear 403 which is independently driven, is fixed on the end portion 404 of the shaft 400. As described above, the recording sheet P is held between the one paired roller group 301 composed of the drive rollers 401 and driven rollers 402 which are respectively provided on a plurality of shafts 400. This system is structured such that, when the recording sheet P is accommodated in the stack section 305, the gear 403 is engaged with the drive gear 407 to drive only the drive roller 401 of the one paired roller group 301 holding the recording sheet P.

Figure 7:
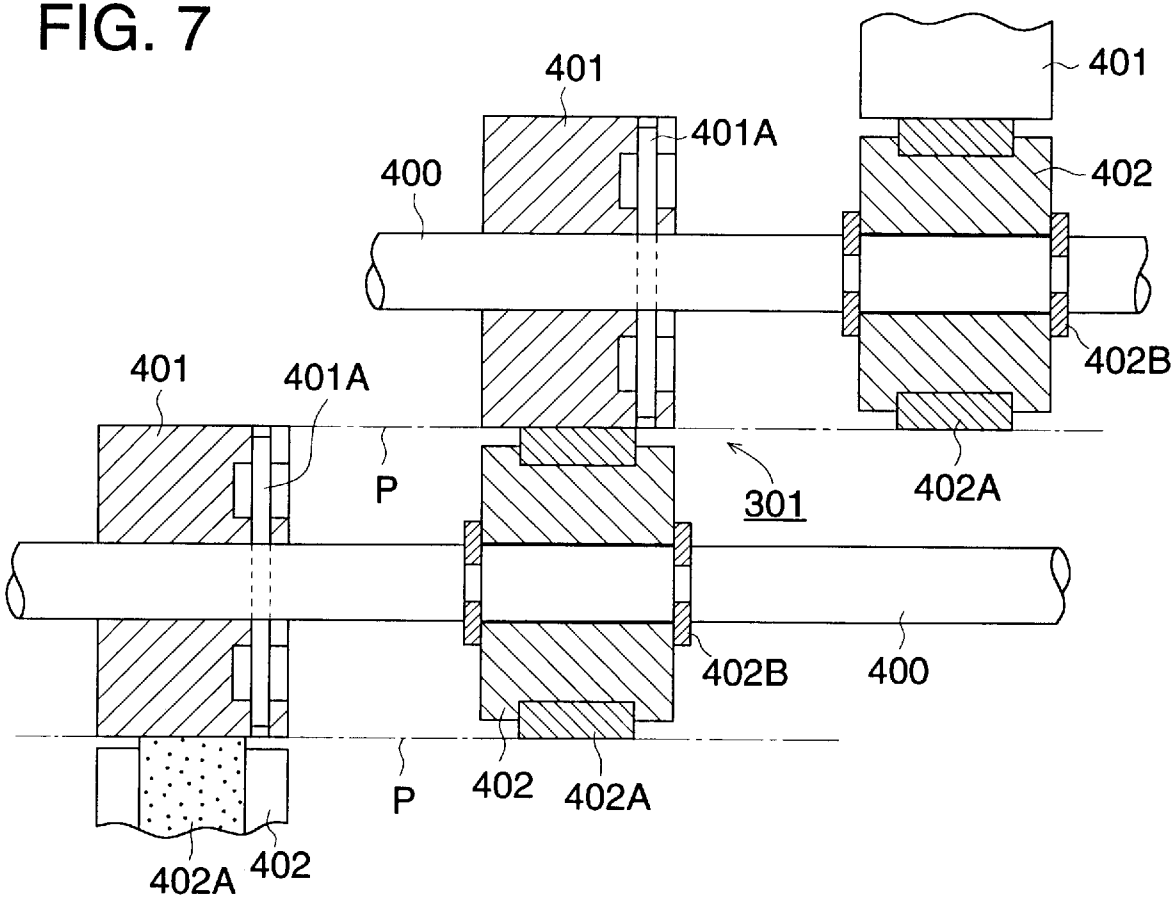
FIG. 7 is an enlarged sectional view showing the recording sheet holding means for two-sided copying of the present invention.

FIG. 7 is an enlarged sectional view showing the drive rollers 401 and the driven rollers 402 respectively provided on a plurality of shafts 400 in the one paired roller group 301.

As shown in the drawing, the drive roller 401 is fixed on one shaft 400 by a fixing pin 401A, and further, the driven roller 402 is rotatably engaged with the shaft 400, and is positioned by an O-ring 402B or the like. Further, an elastic member 402A, formed of rubber or the like, is provided on the outer peripheral portion of the driven roller 402, so that the recording sheet P is securely held and conveyed. As shown in the drawing, the drive roller 401 is also fixed on another shaft 400 by the fixing pin 401A, the driven roller 402 is rotatably engaged with the shaft 400, and a plurality of roller pairs 301, composed of the drive rollers 401 and the driven rollers 402 which are respectively provided on other shafts 400, are provided in this system.

FIGS. 8, 9, 10 and 11 respectively show a drive mechanism to normally rotate or reversely rotate the gear 403 which drives the one paired roller group 301, and a drive mechanism to actuate the grooved cams 408 and 409 which move the one paired roller group 301 provided in the recording sheet accumulation reversing section 302.

Initially, in FIG. 8, a drive gear 500, provided on the drive motor M1 controlled to be reversible by the control section C, is connected to intermediate gears 501, 502, and 503 through a large number of reduction gears. When the intermediate gear 503 is rotated clockwise by the drive motor M1 which is controlled and rotated (as shown by a solid line arrow), the gears 504 and 505 are respectively rotated counterclockwise by being engaged and interlocked with the intermediate gear 503. Support members 600 and 601 are respectively fixed on the gear 504 shaft and the gear 505 shaft. Further, operating portions 602 and 603 are respectively provided on the support members 600 and 601 so that these portions are rotated together with the gears 504 and 505.

On the other hand, an operating member 714 is provided on the other end of an oscillating lever 712, one end of which is fixed on a shaft 711. By the above rotation, the operating portion 602 is also rotated counterclockwise together with the gear 504 which is rotated counterclockwise, and when the leading edge of the operating portion 602 pushes the operating member 714, the oscillating lever 712 is rotated clockwise (shown by a solid line arrow). In this case, the operating portion 603 is also rotated together with the gear 505, and comes into contact with the operating member 714 of the oscillating lever 712. In this case, it is structured such that the operating portion 603 steps aside from the operating member 714.

Further, the drive gear 407 is rotatably provided on the shaft 711, and the drive gear 407 is engaged with the gear 403 as shown in FIGS. 4(*a*)–4(c), 5(*a*), 5(*b*) and 6. Further, a rotation switching gear 713 is rotatably provided on the oscillating lever 712, and the drive gear 407 is also engaged with the rotation switching gear 713.

An intermediate drive gear 706 is provided so that it is rotated only counterclockwise, by intermediate gears 701, 702, 703 and 704 through a reduction gear from a gear 700 provided on a driving motor M2 which is rotated only one-way by the control section C. When the oscillating lever 712 is rotated clockwise as described above, the rotation switching gear 713 is engaged with the intermediate drive gear 706, and rotation of the operating portion 602 is stopped when the driving motor M1 stops. Under this condition, when the driving motor M2 is rotated, only one gear 403, provided on the shaft 400 of the one paired roller group, is rotated clockwise, through the intermediate drive gear 706, the rotation switching gear 713 and the drive gear 407, and after a predetermined number of rotations, the driving motor M2 is stopped and the rotation of the gear 403 is stopped.

That is, as shown in FIGS. 1, 2 and 6, the drive roller 401, constituting the one paired roller group 301, is rotated by the gear 403; it is rotated together with the driven roller 402 in the direction in which the recording sheet P is accommodated in the stack section 305; and the one paired roller group 301 is stopped under the condition that the trailing edge of the recording sheet P remains as described in FIGS. 2 and 4.

Next, the driving motor M1 starts the rotation, and because the intermediate gear 508 is engaged with the drive gear 421, shown in FIG. 3, through the intermediate gears 506, 507, and 508, which are engaged with the intermediate gear 503, bevel gears 414 and 415 are rotated counterclockwise as shown in FIG. 6. By this rotation, the bevel gears 410 and 411 shown in FIG. 3 are rotated, the grooved cams 408 and 409 are rotated, and the end portion 404 of the shaft 400, in contact with the lower position of the grooved cams 408 and 409, is guided and moved to the upper portion by the grooved cams 408 and 409.

In this case, the drive roller 401 and the driven roller 402 are integrally moved with a plurality of shafts 400 provided in the recording sheet accumulation reversing section 302 formed into the reversed L-shape. When the movement has been completed, the rotating condition of the detection member 423 is detected by the detection device 424, and the control section C controls so that the grooved cams 408 and 409 are stopped at the position of one rotation.

Under this condition, the gear 403 provided on the shaft 400 is disengaged from the drive gear 407, and the gear 403 provided on the next shaft 400 is engaged with the drive gear 407. Only one gear 403 provided on the shaft 400 of the one paired roller group 301 is rotated clockwise through the drive gear 407 by the rotation of the intermediate drive gear 706 by the rotation of the driving motor M2, as described above. When the driving motor M2 stops after a predetermined number of rotations and stops the rotation of the gear 403, the recording sheet P is accommodated in the stack section 305 while being held by the one paired roller group 301. Due to the foregoing, the recording sheet P for two-sided copying is successively accommodated in the stack section 305.

Next, a method, by which the recording sheet P accommodated in the stack section 305 is successively reversal-fed, will be described.

In the case of reversal sheet feeding, the rotation of the driving motor M1 is reversed by the control section C. That is, the intermediate gear 503 is rotated counterclockwise by the driving motor M1, which is controlled so that the rotation of the motor M1 is reversed counterclockwise, and is rotated (a dotted line arrow), and thereby, the operating portions 602 and 603 are also rotated clockwise together with gears 504 and 505 which are engaged and interlocked with the intermediate gear 503 and rotated clockwise. When the leading edge of the operating portion 603 pushes the operating member 714, the oscillating lever 712 is rotated counterclockwise. Accordingly, the rotation switching gear 713 provided on the oscillating lever 712 is disengaged from the intermediate gear 706, and is moved to the solid line position in FIG. 8. In that case, the operating portion 602 is also rotated together with the gear 504 as described above, and therefore the operating portion 602 comes into contact with the operating member 714 of the oscillating lever 712. However, in this case also, it is structured so that the operating portion 603 steps aside, and therefore, there is no influence.

On the other hand, the intermediate drive gear 706 driven by the rotation of the driving motor M2, is always engaged with the intermediate gear 708, rotatably provided on the shaft 711, and further, engaged with intermediate gears 709 and 710, and is rotated clockwise together with the intermediate gear 710. When the oscillating lever 712 is rotated counterclockwise as described above, the rotation switching gear 713 provided on the oscillating lever 712 is engaged with the intermediate gear 710. Accordingly, the rotation switching gear 713 is rotated counterclockwise, and the drive gear 407, engaged with the rotation switching gear 713, is rotated clockwise.

By the rotating operation described above, one gear 403 engaged with the drive gear 407, is rotated counterclockwise, and thereby, the recording sheet P, one end of which is held by the one paired roller group 301, is reversely conveyed from the position of the stack section 305. The recording sheet P is guided by the other guide portion of the recording sheet guide member 127 shown in FIG. 1, and after the leading edge of the recording sheet P has been detected by the detection member S7, it is conveyed on the second recording sheet reversal conveyance section 129. The recording sheet P is conveyed again to the register roller 115 position through the detection by the detection members S2 and S1, and an image is recorded on the reverse side of the recording sheet P.

As described above, because the driving motor M1 is reversely rotated by the control section C, the bevel gears 410 and 411 are reversely rotated together with the intermediate gear 508. Accordingly, the end portion 404 of the shaft is moved from the upper position of the grooved cams 408 and 409 to the lower position by the reverse rotation of the grooved cams 408 and 409. As described above, the grooved cams 408 and 409 are stopped after one rotation, and after the next one gear 403 has been engaged with the drive gear 407, the driving motor M2 is driven again, and the next recording sheet P is reversely fed.

Figure 9:
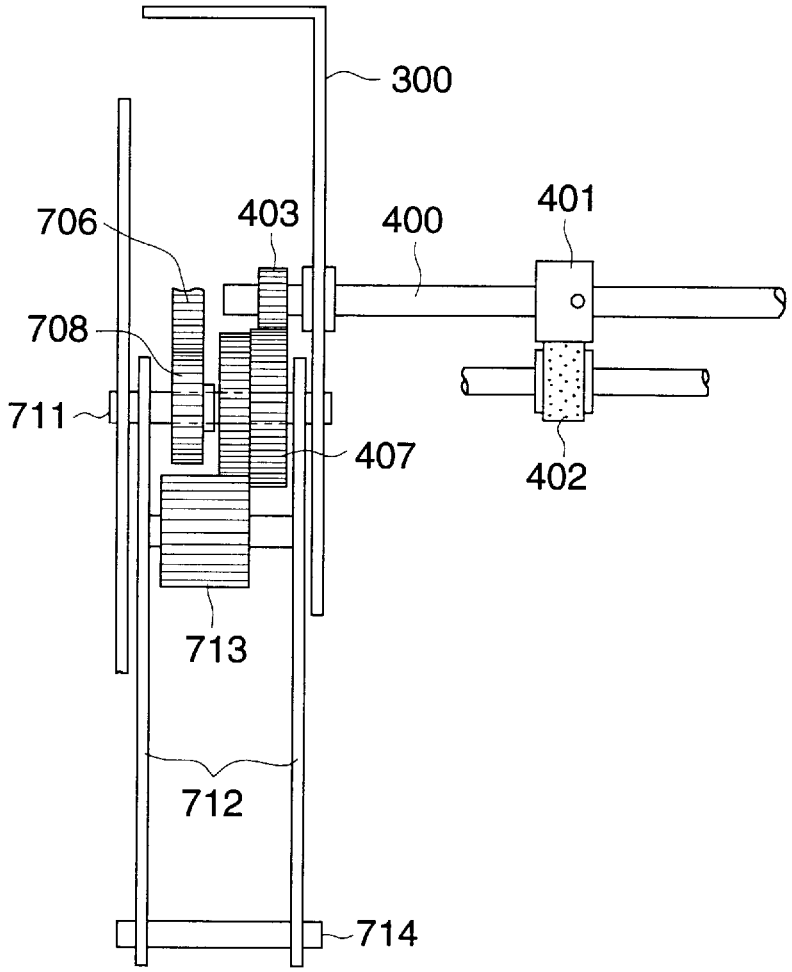
FIG. 9 is a side view showing a portion of the driving mechanism of the recording sheet holding means for two-sided copying of the present invention.

FIG. 9 is a side view of the mechanism showing the relationship of the engagement of the gear 403 engaged with the drive gear 407 shown in FIG. 8, with the rotation switching gear 713 provided on the oscillating lever 712. As shown in the drawing, the shaft 711 is provided on the carriage 300 such that the shaft 711 penetrates the carriage 300. An intermediate gear 708 always engaged with the intermediate gear 706, and the drive gear 407 are rotatably provided on the shaft 711. Further, both ends of the oscillating lever 712 on which operating member 714 is provided, are rotatably provided on the shaft 711. The rotation switching gear 713 is provided on the oscillating lever 712, and is combined with the drive gear 407 so that these gears are always engaged with each other. Further, the mechanism is structured such that only one gear 403 provided on the shaft 400 is engaged with the drive gear 407.

Figure 10:
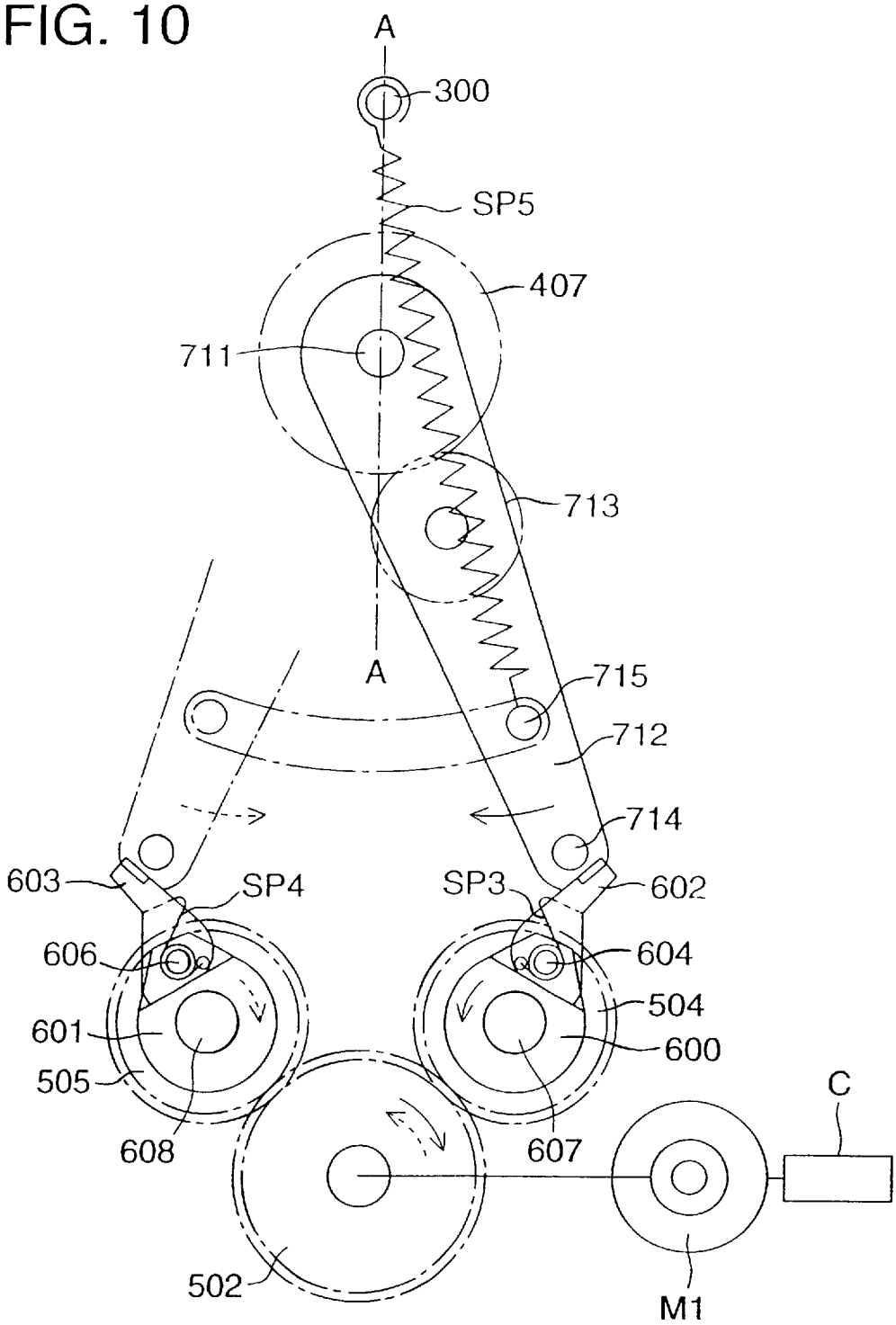
FIG. 10 is a view showing the structure of a portion of the driving mechanism of the recording sheet holding means for two-sided copying of the present invention.

FIG. 10 is a view showing the operation and the concrete structure of the oscillating lever 712 shown in FIG. 8, and the operating portions 602 and 603, which are rotated together with the gears 504 and 505 to operate the oscillating lever 712.

Initially, a spring SP5 which conducts a tumbler operation between a portion of the carriage 300 and a protrusion 715 provided on a portion of the oscillating lever 712, is provided on the oscillating lever 712, and this system is structured such that the oscillating lever 712 is oscillated either right or left with a line A—A as the center, and stopped. The positions of the operating portions 602 and 603 shown in FIG. 8 are shown under the condition that they are respectively moved to the position to actuate the operating member 714 of the oscillating lever 712.

The operating portion 602 is supported by a shaft 604 provided on a supporting member 600 fixed on a shaft 607 of the gear 504 so that the operating portion 602 can be rotated only counterclockwise, and further, a spring member SP3 to force the operating portion 602 clockwise, is provided. When thus structured operating portion 602 is rotated in the normal rotating direction (a solid line arrow), the operating member 714 is activated in the arrowed direction, and the oscillating lever 712 is pushed clockwise, the oscillating lever 712 passes the line A—A, and is moved to a predetermined position by the tumbler action of the spring SP5. When the operating portion 602 is reversely rotated, and the operating member 714 is moved to the solid line position, the operating portion 602 is operated against the spring member SP3 and its rotation is stopped. After the oscillating lever 712 has passed the line A—A, the operating portion 602 returns to the original position by the spring member SP3.

The operating portion 603 is also supported by a shaft 606 provided on a supporting member 601 fixed on a shaft 608 of the gear 505 so that the operating portion 603 can be rotated only clockwise, and further, a spring member SP4 to force the operating portion 603 counterclockwise, is provided. When thus structured operating portion 603 is rotated in the reverse direction (a dotted line arrow), the operating member 714 is activated in the dotted line arrow direction, and the oscillating lever 712 is pushed counterclockwise, the oscillating lever 712 passes the line A—A, and is moved to a solid line position by the tumbler action of the spring SP5. When the operating portion 602 is reversely rotated, and the operating member 714 is moved to the position shown by a one-dotted chain line, the operating portion 603 is operated against the spring member SP4 and its rotation is stopped. After the oscillating lever 712 has passed the line A—A, the operating portion 603 returns to the original position by the spring member SP4.

Figure 11:
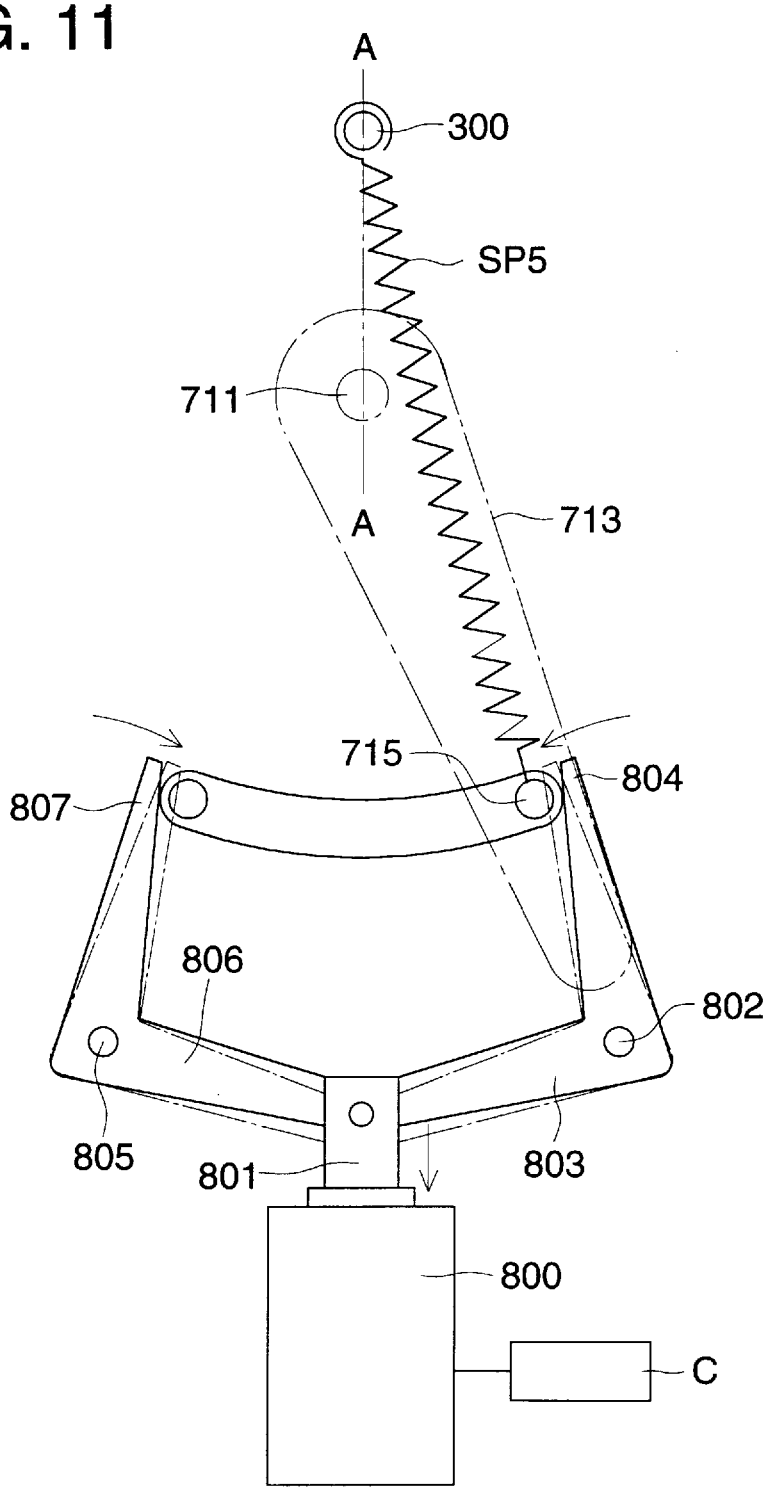
FIG. 11 is a view showing the structure of a portion of the driving mechanism of the recording sheet holding means for two-sided copying of the present invention.

FIG. 11 is a view showing the structure to conduct a holding operation, in order to ensure the oscillating operation of the oscillating lever 712 shown in FIG. 10.

An operating member 801 which is operated by "ON" and "OFF" of the power source, is provided on the solenoid 800 connected to the control section C. On the other hand, operating levers 803 and 806 are rotatably provided respectively on shafts 802 and 805 provided on the carriage 300. Each one end of the operating levers 803 and 806 is engaged with the operating member 801, and both leading edges 804 and 807 are provided such that they are respectively located at both side positions of the range in which the protrusion 715 of the oscillating lever 712 is moved.

As described above, when the operating member 714 of the oscillating lever 712 is moved, for example, clockwise, by the rotation of the operating portion 602, simultaneously, the power source of the solenoid 800 is turned "ON", the operating member 801 is pulled, operating levers 803 and 806 are respectively rotated, and the protrusion 715 is pressed by the leading edge 804 and 807 (in the drawing, the leading edge 804). Accordingly, the oscillating lever 712 is slightly moved clockwise together with the protrusion 715, and the oscillating lever 712 securely moves over the line A—A and is operated by the moving operation of the protrusion 715 by the rotating operation of the operating portion 602, and further by the tumbler action of the spring SP5.

According to the present invention, in a copying apparatus comprising an image forming means, a fixing means for fixing an image on the recording sheet on which an image is formed by the image forming means, and a recording sheet branch means for making the fixed recording sheet branch off in order to deliver it outside the copying apparatus, or to re-feed it into the copying apparatus, the apparatus has a plurality of one paired recording sheet holding conveyance means so that the recording sheet, which is re-fed in the copying apparatus by the recording sheet branch means, is held, stopped while one end of the recording sheet is being held, after the recording sheet is conveyed a predetermined distance, and further the recording sheet is reversed and re-fed to a transfer section, and a support and guide means for movably supporting the plurality of recording sheet holding conveyance means. Accordingly, the recording sheet can be stacked in a stack section for each sheet without contacting with each other, and the recording sheet is not in contact with each other, thereby, the recording sheet can be prevented from being stained. Further, when the recording sheet is re-fed, the recording sheet is separated for each sheet for stacking, and double-sheet feeding can be securely prevented, thereby, no jamming occurs. Still further, a position in the stack section to which the recording sheet is sent, is not necessary to be switched corresponding to the size, and thereby, the apparatus can be placed in a narrow place.

Further, when the plurality of one paired recording sheet holding conveyance means are moved, the connection of a driving means to the recording sheet holding conveyance means is released. Accordingly, the recording sheet, held by the plurality of one paired recording sheet holding conveyance means, does not drop when the recording sheet holding conveyance means is moved, and all recording sheets are surely re-fed and safe.

Still further, in the plurality of one paired recording sheet holding conveyance means, a plurality of drive rollers, and a plurality of driven rollers which are freely rotated with respect to one shaft are alternately provided on the one shaft, and the drive roller and the driven roller are structured as one pair. The recording sheet P can be stacked in the stack section for each one shaft, and thereby, a large number of recording sheets can be accommodated in the stack section in a narrow place.

Furthermore, the plurality of one paired recording sheet holding conveyance means are movably arranged in the reversed L-shape support and guide means, and thereby, they can be efficiently arranged in a narrow place in a portion of a carriage, provided specifically in a two-sided copying apparatus.

Further, the apparatus has a detection means for detecting the trailing edge of the recording sheet which is held and conveyed by the one paired recording sheet holding conveyance means, and thereby, a predetermined position of the trailing edge portion of the recording sheet can be surely held by the recording sheet holding conveyance means.

Still further, the apparatus has a non-contact type detection means for detecting the recording sheet which is held, conveyed and stopped, by the one paired recording sheet holding conveyance means, and thereby, the stacked recording sheet can be surely detected for each sheet without contacting.

Yet further, in a copying apparatus comprising an image forming means, a fixing means for fixing an image on the recording sheet on which an image is formed by the image forming means, and a recording sheet branch means for making the fixed recording sheet branch off in order to deliver it outside the copying apparatus, or to re-feed it into the copying apparatus, the apparatus has a plurality of one paired recording sheet holding conveyance means so that the recording sheet, which is re-fed in the copying apparatus by the recording sheet branch means, is held, conveyed a predetermined distance, and after that, stopped while one end of the recording sheet is being held, and further the recording sheet is reversed and re-fed to a transfer section, a support and guide means for supporting the plurality of recording sheet holding conveyance means, and a moving means by which the recording sheet holding conveyance means is caused to hold each recording sheet, and to be successively moved by the support and guide means. Accordingly, the recording sheet can be stacked in a stack section for each sheet without contacting with each other, and the recording sheet is not in contact with each other, thereby, the recording sheet can be prevented from being stained. Further, when the recording sheet is re-fed, the recording sheet is separated for each sheet for stacking, and therefore, double-sheet feeding can be securely prevented. Still further, a position in the stack section to which the recording sheet is sent, is not necessary to be switched corresponding to the size, and thereby, the apparatus can be placed in a narrow place. In addition to this, the recording sheet is moved while being held by the recording sheet holding conveyance means, and can be accurately re-fed, thereby, no jamming occurs.

Furthermore, the plurality of one paired recording sheet holding conveyance means are movably arranged in the reversed L-shape guide means, and thereby, the plurality of one paired recording sheet holding conveyance means can be smoothly moved from the lower position to the upper position, or from the upper position to the lower position.

Further, the apparatus has a detection means for detecting the trailing edge of the recording sheet which is held and conveyed by the one paired recording sheet holding conveyance means, even when the recording sheet is moved by the support and guide means for supporting the plurality of one paired recording sheet holding conveyance means, the recording sheet can always be surely detected.

Still further, the apparatus has a non-contact type detection means for detecting the recording sheet which is held and conveyed by the one paired recording sheet holding conveyance means and stopped, even when the recording sheet is moved by the support and guide means for supporting the plurality of recording sheet holding conveyance means, specifically at the upper position of the reversed L-shape guide means, the recording sheet can be surely detected.

Yet further, in a copying apparatus comprising an image forming means, a fixing means for fixing an image on the recording sheet on which an image is formed by the image forming means, and a recording sheet branch means for making the fixed recording sheet branch off in order to deliver it outside the copying apparatus, or to feed it into the copying apparatus, after fixing, the apparatus has a plurality of one paired recording sheet holding conveyance means so that the recording sheet, which is fed in the copying apparatus by the recording sheet branch means, is held, conveyed a predetermined distance, and after that, stopped while one end of the recording sheet is being held, and further the recording sheet is reversed and re-fed to a transfer section, a support and guide means for supporting and guiding the plurality of recording sheet holding conveyance means, a rotatable recording sheet guide means for guiding entering of the recording sheet into the one paired recording sheet holding conveyance means, and sending from it, and a moving means by which the recording sheet holding conveyance means is caused to hold each recording sheet, and to be successively moved by the support and guide means. Accordingly, the recording sheet is accurately guided to a holding position of the recording sheet holding conveyance means for each sheet, and is accurately accommodated in the stack position. Further, also when the recording sheet is re-fed by the recording sheet holding conveyance means, the recording sheet is accurately guided to a predetermined conveyance position, and thereby, no jamming occurs.

Furthermore, the plurality of one paired recording sheet holding conveyance means are movably arranged in the reversed L-shape guide means, and the recording sheet is guided to the upper position of the reversed L-shape guide means by the guide means. Accordingly, the recording sheet is smoothly guided and conveyed to the recording sheet holding conveyance means, and the recording sheet re-feeding operation is also smoothly carried out.

Further, the apparatus has a detection means for detecting the trailing edge of the recording sheet which is held and conveyed by the recording sheet holding conveyance means, and therefore, the trailing edge of the recording sheet is accurately held by the recording sheet holding conveyance means, when the recording sheet is smoothly guided by the guide means, and the trailing edge of the recording sheet is detected.

Still further, the apparatus has a non-contact type detection means for detecting the recording sheet, which is held and conveyed by the one paired recording sheet holding conveyance means and is stopped, and therefore, specifically, the recording sheet is accurately guided to the upper position of the reversed L-shaped guide means, and even when the recording sheet is moved by the support and guide means to support the plurality of recording sheet holding conveyance means, the recording sheet can be surely detected.

Yet further, in a copying apparatus comprising an image forming means, a fixing means for fixing an image on the recording sheet on which an image is formed by the image forming means, and a recording sheet branch means for making the fixed recording sheet branch off in order to deliver it outside the copying apparatus, or to re-feed it into the copying apparatus, when the apparatus has a rotatable recording sheet guide member to guide the recording sheet when the recording sheet, which is caused to branch by the recording sheet branch means, is supplied to the one paired recording sheet holding means, and when the recording sheet is re-fed by the one paired recording sheet holding means, the recording sheet can be smoothly and accurately conveyed, and the two-sided copying can be efficiently carried out, when the recording sheet is supplied to the one paired recording sheet holding means, and is conveyed to the accumulation section, and when the recording sheet is re-fed from the accumulation section by the one paired recording sheet holding means.

Furthermore, the one paired recording sheet holding means is movably supported by the support member; the recording sheet is guided and conveyed to the one paired recording sheet holding means and held by it, by the guide of the recording sheet guide member; and the recording sheet guide member is rotated in timed relationship with the movement of the one paired recording sheet holding means, and is withdrawn from the recording sheet end. Thereby, the recording sheet is securely held by the one paired recording sheet holding means, and the stacked recording sheet can be smoothly moved.

Further, when a plurality of the one paired recording sheet holding means are provided on the support member, a large number of recording sheets can be efficiently accommodated in a narrow accumulation section.

Still further, the support member is formed into the reversed L-shape, and the plurality of one paired recording sheet holding means are movably provided on the support member. Thereby, the one paired recording sheet holding means can be efficiently placed in the narrow place, and thereby, the overall size of the two-sided copying apparatus can be reduced.

What is claimed is:

1. A two-sided copying apparatus comprising:

(a) an image forming means for forming an image on a recording sheet;

(b) a fixing means for fixing the image on the recording sheet;

(c) a branching means for branching the recording sheet on which the image was fixed by the fixing means to eject or to feed again to the image forming means for a two-sided image formation;

(d) a plurality of holding means each for holding a vicinity of one edge of the recording sheet fed from the branching means, wherein the holding means temporarily stops while holding the recording sheet and feeds again in a reverse direction to the image forming means; and (e) a supporting and guiding means for supporting and guiding the plurality of holding means.

2. The two-sided copying apparatus of claim 1, wherein each of the holding means is composed of paired holding members.

3. The two-sided copying apparatus of claim 1, wherein each of the holding means is composed of paired rollers.

4. The two-sided copying apparatus of claim 3, wherein the paired rollers can be reversely rotated.

5. The two-sided copying apparatus of claim 3, wherein a plurality driving rollers and a plurality of follower rollers are provided one after another on one shaft, and the paired rollers are composed of the plurality of driving rollers provided on said one shaft and the plurality of follower rollers provided on another shaft positioned next to said one shaft, to be driven by the plurality of driving rollers on said one shaft by contacting with each other.

6. The two-sided copying apparatus of claim 1, wherein each of the holding means interposes vicinity of a trailing edge of the recording sheet and temporarily stops.

7. The two-sided copying apparatus of claim 6, further comprising a detecting means for detecting the trailing edge of the recording sheet.

8. The two-sided copying apparatus of claim 6, further comprising a non-contact type detecting means for detecting the recording sheet temporarily stopped.

9. The two-sided copying apparatus of claim 1, wherein the holding means is movable on the supporting and guiding means.

10. The two-sided copying apparatus of claim 9, further comprising a driving means for driving the holding means, wherein when the holding means is moved, an engagement between the driving means and the holding means is released.

11. The two-sided copying apparatus of claim 1, wherein the supporting and guiding means is formed in an L-shaped form.

12. The two-sided copying apparatus of claim 1, further comprising a rotatable guiding means for guiding the recording sheet to feed toward and to send from the holding means.

13. The two-sided copying apparatus of claim 1, wherein the plurality of holding means composed of a combination of driving rollers provided on one shaft and follower rollers provided on another shaft, and the plurality of holding means composed of a combination of the follower rollers provided on said one shaft and the driving rollers provided on said other shaft, are arranged in the supporting and guiding means one after the other.

14. The two-sided copying apparatus of claim 1, further comprising a driving member for engaging with only one follower member provided on a shaft among the plurality of holding means to rotate said shaft.

15. The two-sided copying apparatus of claim 14, wherein by means of the driving member and said one follower member, each of the holding means interposes the recording sheet fed again inside the apparatus, temporarily stops while holding one edge of the recording sheet and feeds again the recording sheet in a reverse direction onto a transfer station.

16. The two-sided copying apparatus of claim 14, wherein said one follower member is provided on both sides of said shaft.

17. The two-sided copying apparatus of claim 1, further comprising a pressing means for pressing both endmost positions of the holding means.

18. The two-sided copying apparatus of claim 17, wherein each of the pressing means comprises a wire-shaped member stretched at the endmost position, one end of the wire-shaped member is fixed on a main body of the apparatus, and the other end of the wire-shaped member is provided with a resilient member, thereby the plurality of holding means come into contact with each other.

19. The two-sided copying apparatus of claim 18, further comprising an auxiliary resilient member for supporting upwardly the holding means provided in a substantially vertical direction.

20. The two-sided copying apparatus of claim 17, wherein the plurality of holding means is provided on the supporting and guiding means which is formed in an L-shaped form.

21. The two-sided copying apparatus of claim 1, further comprising:

(a) a driving source;

(b) a first gear rotating in a forward direction by the driving source;

(c) a second gear for engaging with the first gear;

(d) a third gear rotating in a direction reverse to that of the first gear through the second gear;

(e) an oscillating member oscillatably provided;

(f) a fourth gear rotatably provided on the oscillating member, for engaging with the first or third gear thereby rotating in the forward direction or the reverse direction according to an oscillation of the oscillating member; and (g) a fifth gear for always engaging with the fourth gear thereby rotating in the forward direction or the reverse direction, wherein the holding means engages with the fifth gear to rotate in the forward or reverse direction.

22. The two-sided copying apparatus of claim 21, wherein the supporting and guiding means is formed in a L-shaped form, and each of the holding means is movably provided on the supporting and guiding means.

23. The two-sided copying apparatus of claim 21, further comprising a plurality of rotatable operating members and a tumbling means, wherein a tip of the oscillating member is operated by the plurality of rotatable operating members, and is held at a plurality of positions by the tumbling means.

24. The two-sided copying apparatus of claim 1, wherein each of the holding means temporarily stops while holding said one edge of the recording sheet in a horizontal direction for accumulation.

25. The two-sided copying apparatus of claim 24, wherein each of the holding means is movably supported on the supporting and guiding means.

26. The two-sided copying apparatus of claim 25, wherein each of the holding means is composed of a group including:

a combination of a driving roller provided on one shaft and a follower roller provided on another shaft next to said one shaft; and a combination of a follower roller provided on said one shaft having said driving roller and a driving roller provided on said other shaft having said follower roller.

27. The two-sided copying apparatus of claim 25, wherein the supporting and guiding means is formed in a L-shaped form composed of a vertical direction guiding portion and a slanting guiding portion.

28. The two-sided copying apparatus of claim 27, wherein when the holding means is moved to the slanting guiding portion of the supporting and guiding means, the recording sheet is fed to the holding means and held in the horizontal direction.

* * * * *